US005394858A

United States Patent [19]

Karolian

[11] Patent Number: 5,394,858

[45] Date of Patent: Mar. 7, 1995

[54] ARROW SAFETY POSITIONING APPARATUS

[75] Inventor: Gary Karolian, Pittsfield, N.H.

[73] Assignee: David R. Laliberte, Manchester, N.H.

[21] Appl. No.: 154,300

[22] Filed: Nov. 18, 1993

[51] Int. Cl.[6] ..... F41B 5/22; F41B 5/14

[52] U.S. Cl. ..... 124/44.5; 124/86

[58] Field of Search ..... 124/23.1, 24.1, 25.6, 124/44.5, 86, 88

[56] References Cited

U.S. PATENT DOCUMENTS

| | | | |
|---|---|---|---|
| 4,453,528 | 6/1984 | Eckert | 124/44.5 |
| 4,686,956 | 8/1987 | Troncoso | 124/44.5 |
| 4,703,745 | 11/1987 | Hammond | 124/44.5 |
| 4,803,971 | 2/1989 | Fletcher | 124/44.5 |
| 5,009,215 | 4/1991 | Ludwig | 124/44.5 |
| 5,143,043 | 9/1992 | Brelsford | 124/24.1 |
| 5,181,502 | 1/1993 | Ray | 124/44.5 |
| 5,235,958 | 8/1993 | Laffin | 124/44.5 |

*Primary Examiner*—Randolph A. Reese
*Assistant Examiner*—John A. Ricci
*Attorney, Agent, or Firm*—William B. Ritchie

[57] ABSTRACT

A safety supporting apparatus for an arrow while the arrow is nocked and positioned on an arrow rest. Two safety arms, that do not touch the arrow, but are sufficiently close to the shaft of the arrow so that if the arrow is laterally dislodged from the rest, the arrow will briefly contact one or both of the arms, causing the arrow to be repositioned on the rest. Once the bow is drawn back into firing position, the arms are automatically rotated away from the arrow, permitting it to be fired without the shaft or fletching contacting the safety supporting arms. An optional third arm is also provided in an alternative embodiment so that vertical displacements from the arrow rest can also be prevented. The apparatus is adaptable for compound, recurve or longbow styles of bow and can be used with or without an overdraw mechanism.

14 Claims, 4 Drawing Sheets

ARROW SAFETY POSITIONING APPARATUS

BACKGROUND OF THE INVENTION

1. Field of the Invention

The invention relates to safety equipment for the sport of archery.

2. Description of the Related Art

The sport of archery has undergone unprecedented growth over the last decade. The advent of compound bows, bow sights and automatic release mechanism enabled archers to substantially increase their accuracy for any given skill level. In addition, more areas of the country, due to ever expanding population pressures, are being removed from permissible rifle hunting regions. Coupled with a desire to engage in a more challenging and sporting activity as well as longer season for bow than firearms has resulted in bow hunting to increase exponentially.

A hunter using a bow and arrow must be substantially closer to the target prey, for example, a deer, than is necessary for a hunter using a firearm. Inherently, this requires greater skill and abilities beyond just being proficient with the weapon. Typically, a bow hunter will dress in a camouflage clothing to avoid detection by the animal being hunted. Since bow hunters must be within 60 feet of their prey, preferably not more than 100 feet, and having a clear unobstructed view, there is much less danger of mistaking another hunter as the hunted animal as is found using firearms.

Additionally, the hunter must patiently wait for extended periods of time, hiding, waiting in a "blind" for the intended prey to happen by. Often, the hunter will attach a removable platform to a tree which serves as place to wait for a deer to move into range.

Regardless of the place selected, the hunter preferably should have his/her arrow in the bow ready to shoot. Regardless of whether the bow is the compound type or the traditional recurved bow, the "at ready" situation is essentially the same. The hunting arrow has a tip having two or more razor sharp blades to ensure deep penetration of the arrow within the animal so that the animal is quickly and humanely killed with a single shot. Bows suitable for hunting have draw weights of at least 50 pounds. Draw weight is defined as the pull, measured in pounds, that is required to pull the bow string back to the bow recommended length of draw. To enable the fired arrow to achieve even greater velocity for the bow's draw weight, frequently, hunters will use a device called an "overdraw". The overdraw attaches to the bow adjacent to the handle in the bow's sight window and enables shorter arrows to be used. The short arrow, having less mass, will achieve a greater velocity when fired, thus producing a greater stopping power for hunting. The arrow is "at ready" within the bow when it is "nocked" that is, the plastic end of the arrow is releasably held by the bow string at the string's nocking point. The shaft of the arrow is supported by an arrow rest. The arrow rest is generally attached to the bow in the sight window, however, if using an overdraw, the rest is attached there, frequently, a part of the overdraw apparatus. The arrow is held on the rest merely by the force of gravity and the extremely slight frictional force existing between the small profile rest and the portion of the shaft resting thereon. Thus, a slight bumping of the arrow, or movement of the bow from a substantially vertical position can cause the arrow to fall off the rest. However, the stability of the arrow on its rest cannot be improved by requiring an increase in the amount of force required to cause the arrow to fall off the rest. To do so, would detrimentally interfere with the accuracy and performance of the arrow.

When the hunter sees an animal come into his/her range of fire, the bow is aimed by drawing the string back, with the arrow still in position described above, while sighting with the bow sight on the animal. Once the bow is fully extended, the sight is placed in "kill zone" on the animal, the string is released, causing the arrow to fire and, hopefully, strike its intended target. Note, however, the hunter does not watch the position of the arrow during the aiming or firing procedure. If the arrow should happen to slip off the rest during or immediately prior to the aiming procedure, it is extremely likely that the arrow will be launched in that out of position condition.

This situation happened to the inventor, causing the arrow to break, with one portion hitting the inventor in the face, narrowly missing an eye, and the other portion striking the deer in a non-vital spot. Despite extensive tracking, the injured animal was not found.

This tragic accident caused the inventor to recognize the need for an arrow safety positioning apparatus.

While arrow positioning devices are currently available, they have not obtained universal acceptance in that present devices require action on the part of the hunter to effect release. Since absolute concentration is required of the hunter to sight his bow and release the arrow on a straight and accurate flight, the additional requirement of also remembering to push an arrow positioning device out of the way is burdensome.

A ramp-type rest having two retaining arms to hold the arrow in place is being manufactured and sold by Browning under the trademark ULTIMATE. This device is said to be suitable for installation in any bow or for use with the Browning overdraw-type apparatus. While this device will hold an arrow in place against horizontal forces, the fletching of the released arrow slams against the arms, potentially damaging the fletching and interfering with the flight of the arrow.

An arrow support safety mechanism, adaptable for all bows, including bows fitted with overdraw devices, that is released as a normal consequence of the aiming procedure, does not touch the arrow except to briefly reposition if the arrow moves on its rests, and does not interfere with the flight of the arrow is not found in the prior art.

SUMMARY OF THE INVENTION

It is an object of the invention to provide an arrow safety positioning device to hold an arrow on its rest until the bow is drawn almost to its full draw length.

It is another object of the invention to provide an arrow safety positioning device that is released automatically when the bow almost reaches it full draw length.

It is still another object of the invention to provide an arrow safety positioning device that positions an arrow on its rest without touching the shaft of the arrow except if the arrow inadvertently falls off its rest.

Another object of the invention is to provide an arrow safety positioning device that can surround the arrow from above the rest and on either side of the rest so that tilting the bow substantially in either direction from its normal vertical position will not result in the arrow falling off its rest.

Still another object of the invention is to provide an arrow positioning device that is released using the cables or bowstring of the bow when the bow is drawn back into the firing position.

It is a final object of the invention to provide an arrow positioning device that has an adjustable release mechanism so that the user can adjust the effort required to release the arrow to its free position, being supported merely by the rest and its nock.

The invention is an arrow positioning apparatus for safely positioning the shaft of an arrow with fletching within a bow having a bowstring and an arrow rest. A mounting assembly for adjustably mounting said apparatus to correspond to the position of the arrow rest on said bow is provided. An axle is rotatably mounted to said mounting assembly. Two positioning arms are adjustably mounted to said axle at a pre-selected, substantially parallel distance from one another. The distance is such that the shaft of the arrow does not contact either positioning arm when the arrow is in place on its rest. Yet, if the arrow should be dislodged from its rest will result in the shaft of the arrow briefly contacting at least one of said arms, thereby causing the arrow to be repositioned on the rest. A release cable is attached to said axle and the bow string of the bow. Drawing the bow back near a firing position causes said arms to be rotated on said axle, freeing the arrow to be released without the shaft and fletching of the arrows contacting said arms during release. Means, attached to said axle, is provided for controlling the force required to rotate said axle enabling said arms to remain positioned adjacent to the shaft of arrow until the bow is drawn back into the firing position.

DETAILED DESCRIPTION OF THE INVENTION

Figure 1:
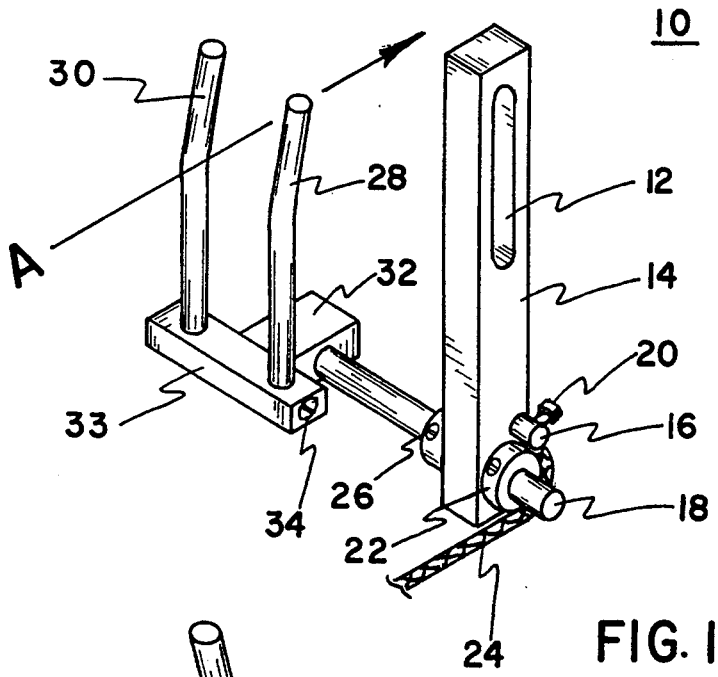
FIG. 1 is an isometric view of the arrow positioning apparatus in accordance with the invention.

FIG. 1 is an isometric view of the arrow safety positioning invention 10. In this embodiment, preferable for use with an overdraw mechanism, invention 10 is attached to the overdraw mechanism (not shown in this figure) by mounting plate 14 with a bolt through mounting slot 12. Slot 12 enables vertical adjustment of invention 10. Block 14 is preferably made from aluminum, however, other durable materials, even plastics could also be used. Plate 14 is preferably about 2½ inches long, ¼ inch thick and ½ inch wide. While these dimensions are not critical, it is important that plate 14 be sufficiently sturdy so invention 10 will be firmly positioned on the bow, without moving under conditions normally experienced when using the bow. Slot 12 is preferably about ¾ inches long and 9/32 inches wide. Again, the dimensions are not critical.

Plate 14 is mounted on shaft 18 by means of collars 22 and 26 which will be described in greater detail below. Shaft 18 is preferably about 5/32 inches in diameter and about 2 inches long. On the other end of shaft 18 is mounted housing 32 and arm support block 33. While support block 33 and housing 32 are preferably one piece aluminum, these parts could also be fabricated separately and joined together using fastening techniques well known in the art. Right and left positioning arms 28 and 30 respectively are mounted in block 33. Arms 28 and 30 are fastened to block 33 using set screws 34. Block 33 is preferably about 1 inch long, ⅜ inches wide and ¼ inch thick. Set screws 34 are preferably ⅛ inch in diameter. Again these dimensions are not critical. However, block 33 must be long enough so that arms 28 and 30 can be distanced to accommodate the diameter of the arrow but not touching the arrow. Arms 28 and 30 are preferably 3/32 aluminum rods, about 2 inches long. As shown, arms 28 and 30 have a slight bend in them and are slidably fitted within block 33 so that the exact distance between arms 28 and 30 can be easily adjusted to accommodate most bow, arrow, arrow rest/overdraw device combinations.

Note that direction A depicts the approximate position of an arrow within the invention 10 with tip of the arrow pointing in the same direction as indicated by A. Invention 10 is manually put into position by the user. Release cable 24 is attached to release cable set screw 20. Release cable set screw 20 serves the dual purpose of locking collar 22 in place and causing shaft 18 to rotate when cable 24 is pulled. Stop 16 is used to adjust the starting position of shaft 18 before rotation has been initiated so that arms 28 and 30 will be precisely aligned to safely position an arrow.

Figure 1A:
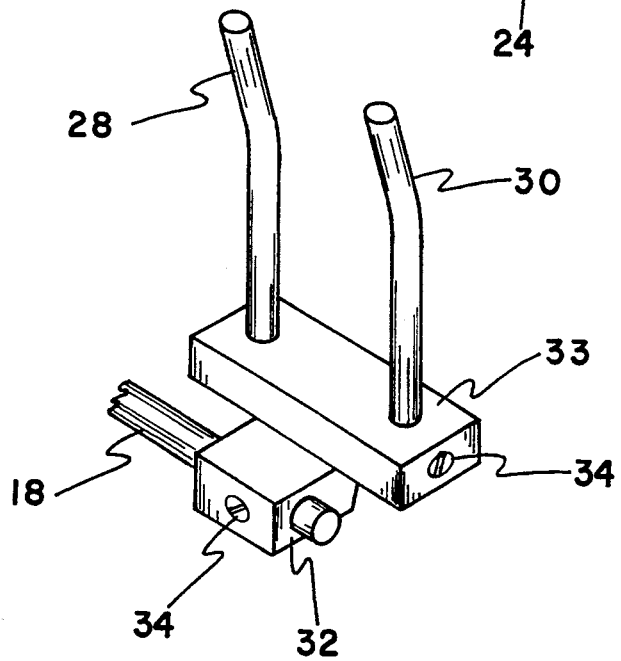
FIG. 1A is a detailed view of the positioning arms within their housing.

FIG. 1A is a detailed view of the positioning arms 28 and 30 within block 33/housing 34 which is mounted to shaft 18. Housing 32 is adjustably positioned on shaft 18 via set screw 34. Set screw 34 which holds arm 30 in place is shown mounted on the end of arm support block 33 which is the preferable position for this embodiment. However, it could also be placed on the front or back permit the vertical position adjustment of arm 30. This is also true of set screw 34 (shown in FIG. 1) that adjusts the vertical position of arm 28. The reason for offsetting block 33 from shaft 18 using housing 32 is to permit arms 28 and 30 to be adjacent to the arrow rest, yet completely away from the arrow and its fletching when release cable 24 causes the invention to rotate about shaft 18.

Figure 1B:
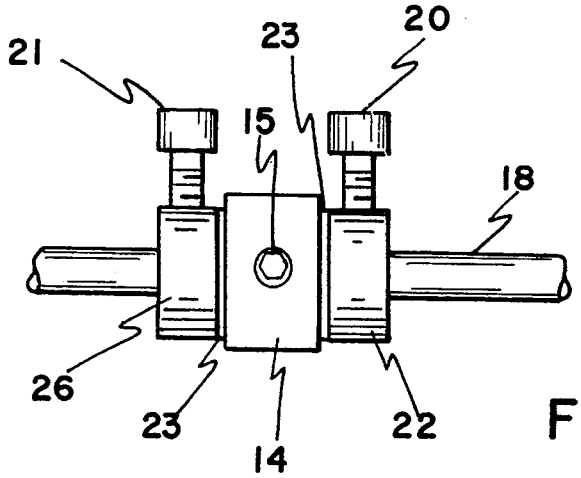
FIG. 1B is a detailed bottom view of the mounting assembly.

FIG. 1B is a detailed bottom view showing plate 14 in position on shaft 18. A very important part of this subassembly is tensioning set screw 15. Screw 15 adjusts the amount of tension that must be placed on cable 14 before collar 24 is rotated. Clearly, if too little tension is placed on screw 15, arms 28 and 30 may move out of position before cable 24 is activated. On the other hand, if screw 15 is set with too much tension, this may unnecessarily interfere with drawing back the bow. Therefore, precise adjustment is required but the exact amount of tension will depend on the personal preference of the user, in many respects, comparable to adjusting the trigger pull of a firearm. Washers 23 are inserted between collar 22 and plate 14 and between collar 26 and plate 14 so that shaft, 18 can turn easily without collars 22 and 16 binding against the contact surface on plate 14. A number of alternatives could be used for set screw 15. The preferred embodiment requires the use of Teflon or other plastic surface contacting shaft 18 so that tension can be placed on screw 15 without resulting in shaft 18 being scored by the end of set screw 15.

Figure 2A:
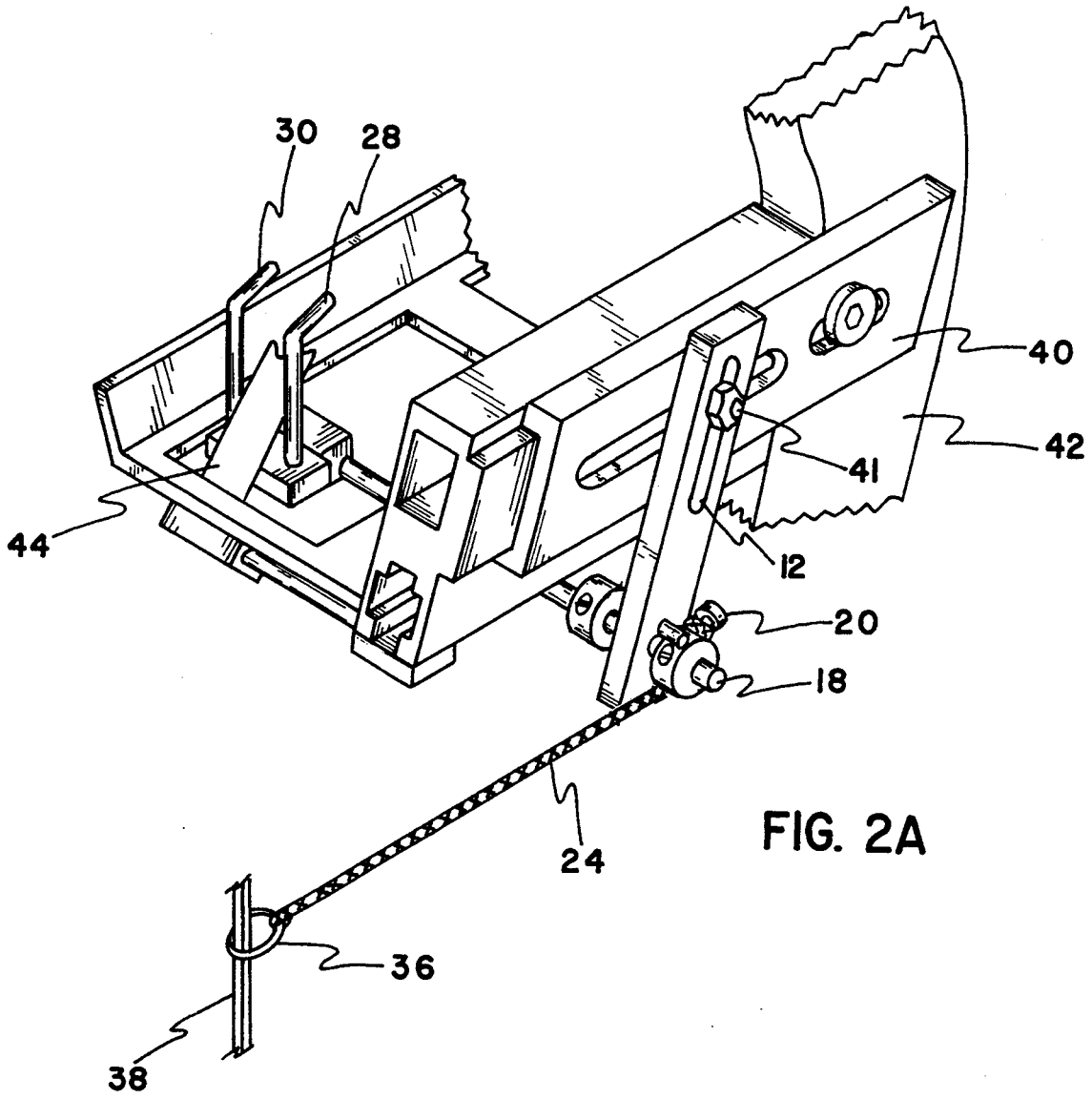
FIG. 2A is a right isometric view of the invention mounted on a typical overdraw mechanism.
Figure 2B:
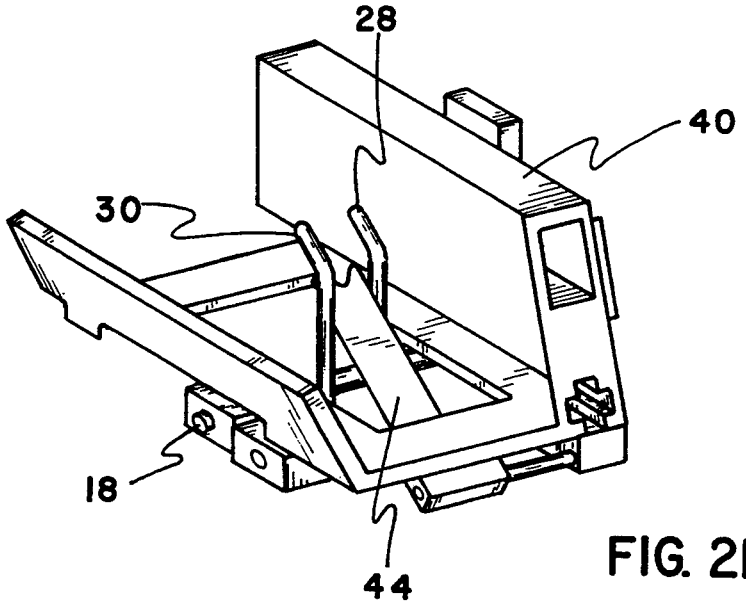
FIG. 2B is a left isometric view of the invention mounted on the overdraw mechanism shown in FIG. 2A.

FIGS. 2A and 2B are isometric right and left side views of invention 10 mounted on a typical overdraw mechanism 40. Mechanism 40 is shown as it is typically mounted to bow handle 42. Invention 10 is mounted to overdraw 40 through slot 12 via bolt and nut assembly 41. Once properly positioned relative to overdraw 40 and its arrow rest 44, arms 28 and 30 will prevent an arrow (not shown) from falling off rest 44. Arms 28 and 30 are distanced from each other so that neither of them touches the shaft of the arrow but is close enough to the arrow to cause it become re-centered on rest 44 if it should be laterally displaced. Arms 28 and 30 are rotated forward and out of the way as the bow is drawn into firing position, causing compound cables 38 (or the bowstring, in the case of a recurve or long bow) to be moved backwards thus pulling on cable 24, thus causing shaft 18 to rotate. Note that cable 24 is attached to compound cable 38 via split ring 36. However, cable 24 could be merely tied in knot around cable 38 as is shown in FIG. 4.

Figure 3:
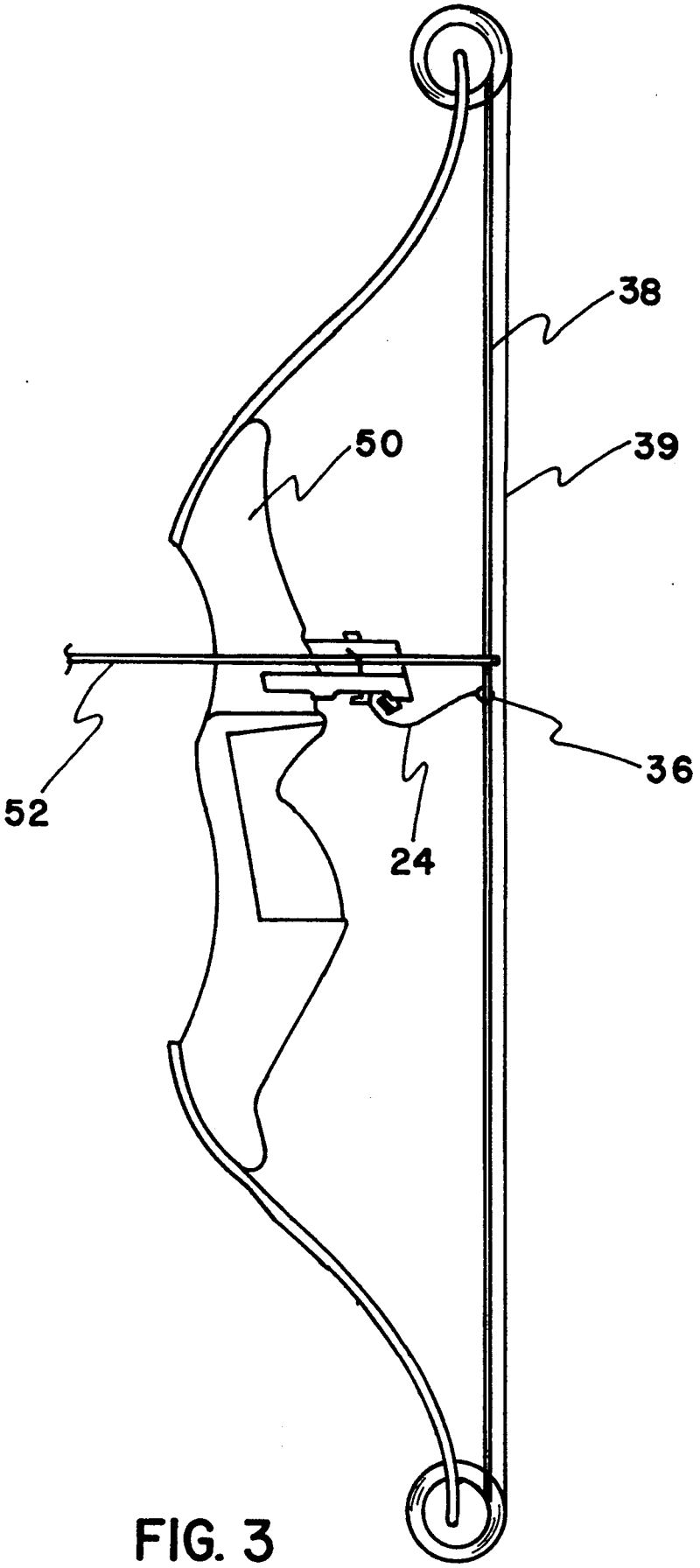
FIG. 3 is a side view of the invention in place on a typical compound bow.

FIG. 3 is a side view of the invention in place on a typical compound bow 50. Cable 24 is attached to the compound cable 38 of bow 50. Arrow 52 is kept in position on its arrow rest by the invention and being nocked onto bow string 39. As bow string 39 is pulled back into firing position, cable 38 is also drawn backwards, pulling cable 24 to release the invention, permitting arrow 52 to be fired without its fletching or shaft contacting the invention. As shown above, the invention can be adjusted by the tensioning screw 15 and the length of cable 24 so that the arrow is provided with safety positioning until the bow is just shy of its full draw length and the arrow is ready to be fired. Thus, the archer can concentrate on his/her target without having to check to make certain that his/her arrow has not slipped off the delicate perch provided by an arrow rest.

Figure 4:
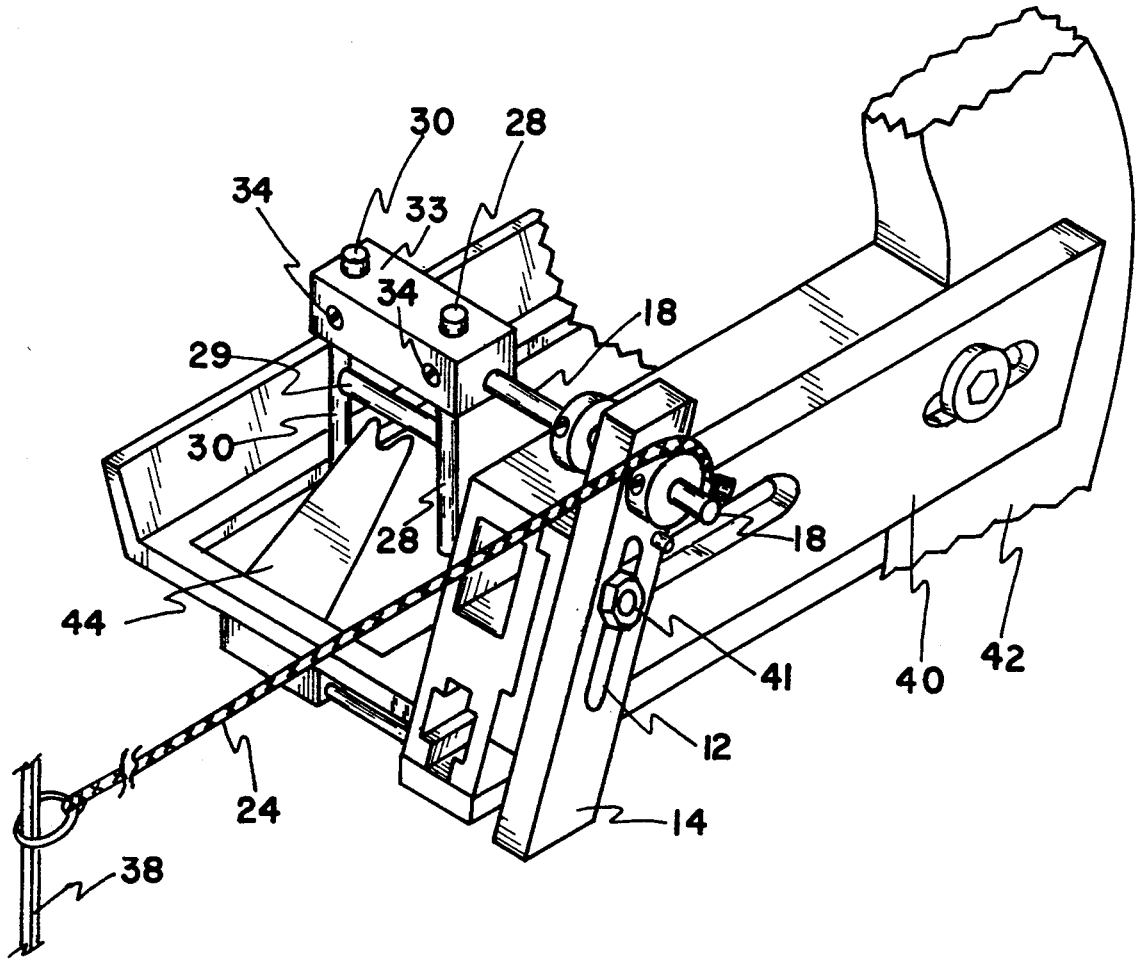
FIG. 4 is an isometric view of the invention alternatively mounted on a typical overdraw mechanism.

FIG. 4 is an isometric view of the invention alternatively mounted on a typical overdraw mechanism. In this view, invention 10 is again mounted as before except the safety positioning support is provided from the top rather than the bottom. That is, shaft 18 is mounted above the horizontal position of the arrow. The operation is the same except the offset assembly comprising housing 32 and arm support block 33 can be replaced by a single arm support block 33'. Block 33' is shown as a rectangular block, however, it could also be round, for example, integral with shaft 18. Horizontal bar 29 can be used to provide additional safety positioning so that the bow could even be turned upside down and the arrow will again properly position itself on the rest when the bow was righted into its proper firing position. As shown, arms 28 and 30 also extend through block 33' as they do through block 33 so that vertical placement of the arms can be adjusted.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An arrow safety positioning apparatus for positioning the shaft of an arrow with fletching on an arrow rest of a bow, said apparatus comprising:

a mounting assembly for adjustably mounting said apparatus to correspond to the position of the arrow rest on said bow;

an axle, rotatably mounted to said mounting assembly;

two positioning arms, adjustably mounted to said axle at a pre-selected, substantially parallel distance from one another, such that the shaft of the arrow does not contact either positioning arm when the arrow is in place on its rest yet, if the arrow should be laterally dislodged from its rest will result in the shaft of the arrow briefly contacting at least one of said arms, thereby causing the arrow to be repositioned on the rest;

release cable, attached to said axle and the bow, wherein drawing the bow back near a firing position causes said arms to be rotated on said axle, freeing the arrow to be released without the shaft and fletching of the arrows contacting said arms during the arrow's release from the bow;

means, attached to 'said axle, for controlling the force required to rotate said axle enabling said arms to remain positioned adjacent to the shaft of arrow until the bow is drawn back into the firing position.

2. The arrow safety positioning apparatus of claim 1 wherein said axle is mounted below the horizontal position of the arrow when the arrow is supported by the arrow rest within the bow.

3. The arrow safety positioning apparatus of claim 2 wherein said apparatus is mounted to the bow by means of an overdraw mechanism.

4. The arrow safety positioning apparatus of claim 2 wherein said apparatus is mounted to the bow at its handle.

5. The arrow safety positioning apparatus of claim 4 wherein said release cable is attached to the bow via the bow string.

6. The arrow safety positioning apparatus of claim 2 wherein said release cable is attached to the bow via a compound cable of the bow.

7. The arrow safety positioning apparatus of claim 2 wherein apparatus is an integral part of an overdraw mechanism.

8. The arrow safety positioning apparatus of claim 1 wherein said axle is mounted above the horizontal position of the arrow when the arrow is supported by the arrow rest within the bow.

9. The arrow safety positioning apparatus of claim 8 wherein said apparatus is mounted to the bow by means of an overdraw mechanism.

10. The arrow safety positioning apparatus of claim 8 wherein said apparatus is mounted to the bow at its handle.

11. The arrow safety positioning apparatus of claim 9 wherein said release cable is attached to the bow via the bow string.

12. The arrow safety positioning apparatus of claim 8 wherein said release cable is attached to the bow via a compound cable of the bow.

13. The arrow safety positioning apparatus of claim 8 wherein apparatus is an integral part of an overdraw mechanism.

14. The arrow safety positioning apparatus of claim 8 further comprising a third safety supporting arm attached between said arms such that the shaft of the arrow does not contact said third safety supporting arm when the arrow is in place on its rest yet, if the arrow should be vertically dislodged from its rest will result in the shaft of the arrow briefly contacting said third safety supporting arm, thereby causing the arrow to be repositioned on the rest.

* * * * *